US006454053B2

(12) United States Patent
Tominaga et al.

(10) Patent No.: US 6,454,053 B2
(45) Date of Patent: Sep. 24, 2002

(54) ELEVATOR APPARATUS INCLUDING RECHARGEABLE POWER SUPPLY AND TEMPERATURE SENSITIVE CHARGING CONTROL

(75) Inventors: Shinji Tominaga, Tokyo (JP); Ikuro Suga, Tokyo (JP); Shinobu Tajima, Tokyo (JP); Hiroshi Araki, Tokyo (JP); Kazuyuki Kobayashi, Tokyo (JP)

(73) Assignees: Mitsubishi Denki Kabushiki Kaisha, Tokyo (JP); The Tokyo Electric Power Company, Inc, Tokyo (JP)

( * ) Notice: Subject to any disclaimer, the term of this patent is extended or adjusted under 35 U.S.C. 154(b) by 0 days.

(21) Appl. No.: 09/774,024

(22) Filed: Jan. 31, 2001

(30) Foreign Application Priority Data

Feb. 28, 2000 (JP) ..... 2000-051944

(51) Int. Cl.[7] ..... B66B 1/06
(52) U.S. Cl. ..... 187/290; 187/296; 320/150
(58) Field of Search ..... 187/290, 296; 320/106, 166, 150, 153

(56) References Cited

U.S. PATENT DOCUMENTS 4,287,465 A * 9/1981 Godard et al. ..... 320/56
4,316,097 A * 2/1982 Reynolds ..... 187/29
5,058,710 A * 10/1991 Iwasa ..... 187/114
5,623,195 A * 4/1997 Bullock et al. ..... 320/22
5,712,456 A 1/1998 McCarthy et al. ..... 187/290
5,900,717 A * 5/1999 Lee ..... 320/150
5,936,375 A 8/1999 Enoki ..... 318/727

FOREIGN PATENT DOCUMENTS

| | | |
|---|---|---|
| JP | 61-267675 | 11/1986 |
| JP | 5-338947 | 12/1993 |
| JP | 7-252040 | 10/1995 |
| JP | 10-67469 | 3/1998 |
| JP | 11-217193 | 8/1999 |

* cited by examiner

*Primary Examiner*—Jonathan Salata
(74) *Attorney, Agent, or Firm*—Leydig Voit & Mayer, Ltd.

(57) ABSTRACT

An elevator control apparatus includes a converter; an inverter; a controller for controlling a motor based on the AC power having a variable voltage and a variable frequency supplied from the inverter and operating an elevator; a power storage unit for storing the DC power; a thermistor for detecting temperature of the power storage unit; a charge/discharge control circuit for controlling a charging and discharging of the power storage unit based on the detected temperature and issuing a drive signal; and a charge/discharge circuit for charging and discharging the power storage unit based on the drive signal. The elevator control apparatus estimates a charging and discharging capability of the power storage unit and protecting the power storage unit, restraining sudden deterioration of the power storage unit.

17 Claims, 14 Drawing Sheets

ELEVATOR APPARATUS INCLUDING RECHARGEABLE POWER SUPPLY AND TEMPERATURE SENSITIVE CHARGING CONTROL

BACKGROUND OF THE INVENTION

1. Field of the Invention

The present invention relates to an elevator control apparatus that utilizes a power storage unit and, more particularly, to an elevator control apparatus adapted to control the temperature of the power storage unit.

2. Description of the Related Art

A conventional elevator control apparatus will be described with reference to an accompanying drawing. FIG. 20 shows a construction of a conventional elevator control apparatus disclosed in, for example, Japanese Unexamined Patent Application Publication No. 61-267675.

The controlling apparatus shown in FIG. 20 includes a commercial three-phase AC power source 1, a converter 2 composed of diodes or the like, a capacitor 3, an inverter 4, a motor 5, such as an induction motor, a hoisting machine 6, an elevator car 7, a counterweight 8, and a rope 9. The controlling apparatus further includes a power storage unit 10 composed of a battery, a charging and discharging (hereinafter referred to as "charge/discharge) circuit 11 composed of a DC/DC converter or the like for performing power conversion in both directions between two different DC voltages of a battery voltage and an inverter input voltage, a charge/discharge control circuit 12 for controlling the charge/discharge circuit 11 as to the direction of power conversion and battery currents, a voltage detector 13, a voltage detector 14 for the power source, a battery current detector 15, and a battery charge amount detector 16.

An operation of the foregoing conventional elevator control apparatus will now be described with reference to the accompanying drawing.

If the AC power source 1 incurs a power failure, power is supplied to an input section of the inverter 4 from the power storage unit 10 through the charge/discharge circuit 11. Thus, the motor 5 is driven by the inverter 4 to land an elevator.

In normal operation, if an inverter input voltage drops while the elevator is accelerating, power is supplied to the input section of the inverter 4 from the power storage unit 10 through the charge/discharge circuit 11 to restrain a voltage-drop at the input section of the inverter 4.

Conversely, if the inverter input voltage rises due to regenerative electric power from the motor 5 while the elevator is being braked, power is supplied from the input section of the inverter 4 to the power storage unit 10 through the charge/discharge circuit 11 so as to charge the power storage unit 10. When the charge amount of the power storage unit 10 becomes low, power is also supplied to the power storage unit 10 from the input section of the inverter 4 through the charge/discharge circuit 11 so as to charge the power storage unit 10.

The conventional elevator control apparatus described above employs a battery for the power storage unit. Charge and discharge characteristics of the battery vary depending on temperature. There has been a problem in that charging all regenerative electric power of the elevator causes a sudden rise in the temperature of the battery especially at a low temperature, and a gas is generated in the battery, leading to significant deterioration of the battery.

SUMMARY OF THE INVENTION

Accordingly, the present invention has been made with a view toward solving the problem mentioned above, and it is an object of the present invention to provide an elevator control apparatus that is capable of measuring an atmospheric temperature and a temperature of a battery to control charging and discharging so as to restrain deterioration of the battery, and also capable of conducting control of economical charging and discharging of the, battery thereby to minimize waste of power.

To this end, according to one aspect of the present invention, there is provided an elevator control apparatus including: a converter for rectifying AC power to convert it into DC power; an inverter for converting the DC power into AC power of a variable voltage and a variable frequency; a controller for controlling a motor base on the AC power of a variable voltage and a variable frequency so as to operate an elevator; a power storage unit for storing the DC power; temperature detecting means for detecting a temperature of the power storage unit; a charge/discharge control circuit for controlling a charge/discharge electric energy based on the detected temperature and issuing a drive signal; and a charge/discharge circuit for charging and discharging the power storage unit based on the drive signal.

According to another aspect of the present invention, there is provided an elevator control apparatus including: a converter for rectifying AC power to convert it into DC power; an inverter for converting the DC power into AC power of a variable voltage and a variable frequency; a controller for controlling a motor based on the AC power of a variable voltage and a variable frequency so as to operate an elevator; a power storage unit for storing the DC power; temperature detecting means for detecting an environmental temperature; a charge/discharge control circuit for controlling a charge/discharge electric energy based on the detected temperature and issuing a drive signal; and a charge/discharge circuit for charging and discharging the power storage unit based on the drive signal.

In a preferred form of the present invention, the charge/discharge control circuit issues a drive signal so that charging is carried out within a permissible range of a charge state of the power storage unit if a detected temperature of the power storage unit is lower than a preset predetermined temperature.

In another preferred form of the present invention, the charge/discharge control circuit changes a setting range of the charge state of the power storage unit based on the detected temperature.

In yet another preferred form of the present invention, the charge/discharge control circuit changes an upper limit value of the charge state of the power storage unit based on a mean temperature of the temperatures detected during a preset predetermined period of time.

In still another preferred form of the present invention, the charge/discharge control circuit changes the upper limit value of the charge state of the power storage unit based on a lowest temperature of the temperatures detected during a preset predetermined period of time.

In a further preferred form of the present invention, the charge/discharge control circuit carries out control so that an input voltage of the inverter is set at a constant voltage of a preset predetermined voltage, carries out control so that, when charge current to the power storage unit reaches a preset predetermined upper limit value based on the detected temperature, the charge current does not exceed the upper limit value, and issues a drive signal for charging the power storage unit with regenerative electric power.

In another preferred form of the present invention, the charge/discharge control circuit carries out control to charge the power storage unit with regenerative electric power so that an input voltage of the inverter is set at a constant voltage of a preset predetermined voltage, and issues a drive signal for stopping charging the power storage unit with regenerative electric power when a voltage of the power storage unit reaches a preset predetermined upper limit value based on the detected temperature.

In yet another preferred form of the present invention, the charge/discharge control circuit carries out control so that charge current supplied to the power storage unit is set at a constant current of a preset predetermined current value, and issues a drive signal for charging the power storage unit with the regenerative electric power while conducting control to set the charge current supplied to the power storage unit at a constant current restricted to be lower than the predetermined current value if the detected temperature is not more than a first preset predetermined temperature or not less than a second preset predetermined temperature that is higher than the first predetermined temperature.

In still another preferred form, the elevator control apparatus further includes a resistor disposed in the vicinity of the power storage unit, wherein the charge/discharge control circuit causes the resistor to consume regenerative electric power if the detected temperature of the power storage unit is a predetermined temperature or less.

In yet another preferred form, the elevator control apparatus further includes a second resistor disposed at a location away from the power storage unit, wherein the charge/discharge control circuit causes the resistor disposed in the vicinity of the power storage unit to consume regenerative electric power if the detected temperature of the power storage unit is below a predetermined temperature, or causes the second resistor to consume the regenerative electric power if the detected temperature of the power storage unit is a predetermined temperature or more and the power storage unit cannot be charged with the regenerative electric power.

According to another aspect of the present invention, there is provided an elevator control apparatus including: a converter for rectifying AC power to convert it into DC power; an inverter for converting the DC power into AC power of a variable voltage and a variable frequency; a controller for controlling a motor based on the AC power of a variable voltage and a variable frequency so as to operate an elevator; a power storage unit for storing the DC power; clock means for counting day and time; a charge/discharge control circuit for controlling a charge/discharge electric energy based on an acquired day and time from the clock means and for issuing a drive signal; and a charge/discharge circuit for charging or discharging the power storage unit based on the drive signal.

In a preferred form of the above elevator control apparatus, the charge/discharge control circuit changes a setting range of the charge state of the power storage unit based on the detected temperature.

In yet another preferred form of the above elevator control apparatus, the charge/discharge control circuit changes an upper limit value of the charge state of the power storage unit based on a mean temperature of the temperatures detected during a preset predetermined period of time.

In still another preferred form of the above elevator control apparatus, the charge/discharge control circuit changes the upper limit value of the charge state of the power storage unit based on a lowest temperature of the temperatures detected during a preset predetermined period of time.

In a further preferred form of the above elevator control apparatus, the charge/discharge control circuit carries out control so that an input voltage of the inverter is set at a constant voltage of a preset predetermined voltage, and issues a drive signal for carrying out control so that, when charge current to the power storage unit reaches a preset predetermined upper limit value based on the detected temperature, the charge current does not exceed the upper limit value to charge the power storage unit with regenerative electric power.

In another preferred form of the above elevator control apparatus, the charge/discharge control circuit carries out control to charge the power storage unit with regenerative electric power so that an input voltage of the inverter is set at a constant voltage of a preset predetermined voltage, and issues a drive signal for stopping charging the power storage unit with regenerative electric power when a voltage of the power storage unit reaches a preset predetermined upper limit value based on the detected temperature.

In yet another preferred form of the above elevator control apparatus, the charge/discharge control circuit carries out control so that charge current supplied to the power storage unit is set at a constant current of a preset predetermined current value, and issues a drive signal for conducting control to set the charge current supplied to the power storage unit at a constant current restricted to be lower than the predetermined current value to charge the power storage unit with the regenerative electric power if the detected temperature is a first preset predetermined temperature or lower, or a second preset predetermined temperature or more that is higher than the first predetermined temperature.

DESCRIPTION OF THE PREFERRED EMBODIMENTS

First Embodiment

Figure 1:
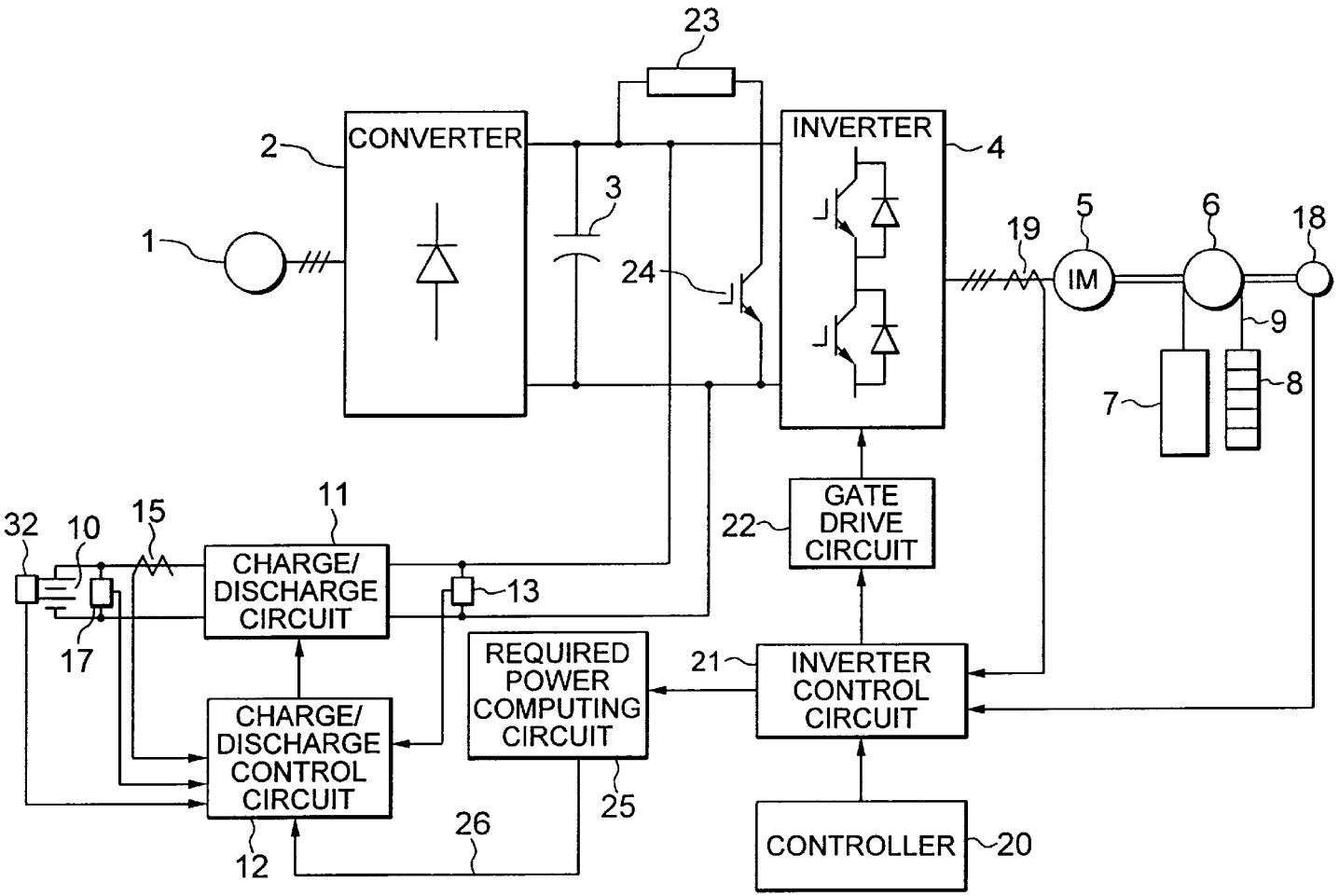
FIG. 1 is a diagram showing a construction of an elevator control apparatus according to a first embodiment of the present invention.

An elevator control apparatus according to a first embodiment of the present invention will be described in conjunction with the accompanying drawings. FIG. 1 is a diagram showing a construction of the elevator control apparatus according to the first embodiment of the present invention. In the drawings, like reference numerals will denote like or equivalent components.

The elevator control apparatus shown in FIG. 1 includes a commercial three-phase AC power source 1, a converter 2 composed of diodes or the like, a capacitor 3, an inverter 4, a motor 5, such as an induction motor, a hoisting machine 6, an elevator car 7, a counterweight 8, and a rope 9.

The motor 5 rotationally drives the hoisting machine 6 to move the elevator car 7 and the counterweight 8 connected to the two ends of the rope 9 so as to carry passengers in the car 7 to a predetermined floor level.

The converter 2 composed of diodes or the like rectifies AC power supplied from the AC power source 1 to convert it into DC power. The inverter 4 composed of transistors, IGBTs or the like converts DC power into AC power of a variable voltage and a variable frequency.

The elevator control apparatus shown in the drawing further includes a power storage unit 10 composed of a battery or the like, a charge/discharge circuit 11 composed of a DC/DC converter or the like for performing power conversion in both directions between two different DC voltages of the power storage unit 10 and an inverter input voltage, a charge/discharge control circuit 12 which is equipped with a clocking function and controls the charge/discharge circuit 11 as to the direction of power conversion and charge/discharge currents, a voltage detector 13, and a current detector 15 composed of a current transformer or the like for detecting input/output currents of the power storage unit 10.

The elevator control apparatus shown in the drawing further includes a voltage detector 17, an encoder 18, a current detector 19, a controller 20, an inverter control circuit 21, and a gate drive circuit 22.

The controller 20 controls start and stop of the elevator, and also creates instructions for start/stop positions and speeds. Based on commands of the controller 20, the inverter control circuit 21 rotationally drives the motor 5 based on current feedback from the current detector 19 and speed feedback from an encoder 18 mounted on the hoisting machine 6 so as to implement the control of the position and speed of the elevator. At this time, the inverter control circuit 21 controls output voltage and frequency of the inverter 4 via the gate drive circuit 22.

In the drawing, reference numeral 23 denotes a resistor, and reference numeral 24 denotes a switching means, such as an IGBT.

If a voltage applied to the capacitor 3 exceeds a predetermined value, the controller 20 turns on the switching means 24 to pass current through the resistor 23 so as to thermally consume a part of power stored in the capacitor 3. When the voltage of the capacitor 3 lowers to a predetermined value or less, the switching means 24 is turned off.

FIG. 1 further shows a required power computing circuit 25 for computing required power of the elevator, a communication cable 26 for transmitting a signal indicating the required power computed by the required power computing circuit 25, and a thermistor 32 for measuring a temperature of the power storage unit 10. The measured temperature data is supplied to the charge/discharge control circuit 12.

The counterweight 8 of the elevator is set such that it is balanced when the car 7 is loaded with a moderate number of passengers. For example, when the elevator travels in a balanced state, it is possible to increase the speed of the elevator while consuming electric power in an acceleration mode, and to turn accumulated speed energy back into electric power in a deceleration mode.

Figure 2:
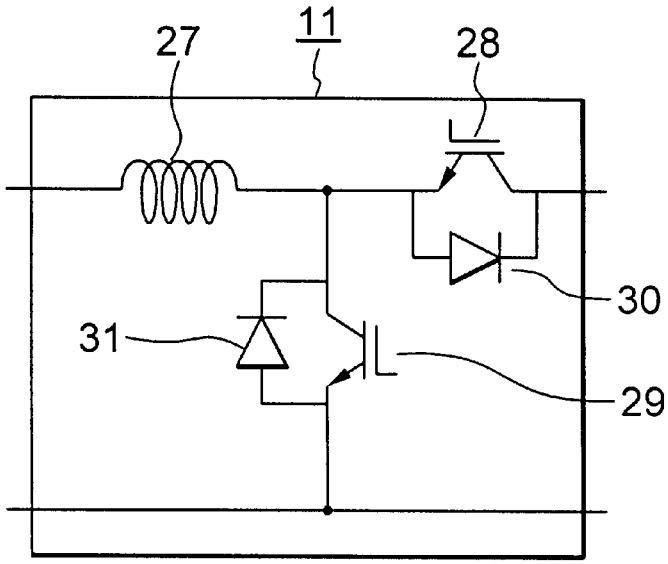
FIG. 2 is a diagram showing a configuration of a charge/discharge circuit of the elevator control apparatus according to the first embodiment of the present invention.

FIG. 2 shows a circuit configuration of the charge/discharge circuit 11 of FIG. 1. Referring to FIG. 2, reference numeral 27 denotes a reactor, reference numerals 28 and 29 denote switching devices, such as IGBTs or the like, and reference numerals 30 and 31 denote diodes that are connected inversely in parallel.

The power storage unit 10 is charged by a step-down chopper circuit formed by the switching device 28 and the diode 31. Discharging from the power storage unit 10 is performed by a step-up chopper circuit formed by the switching device 29 and the diode 30.

Figure 3:
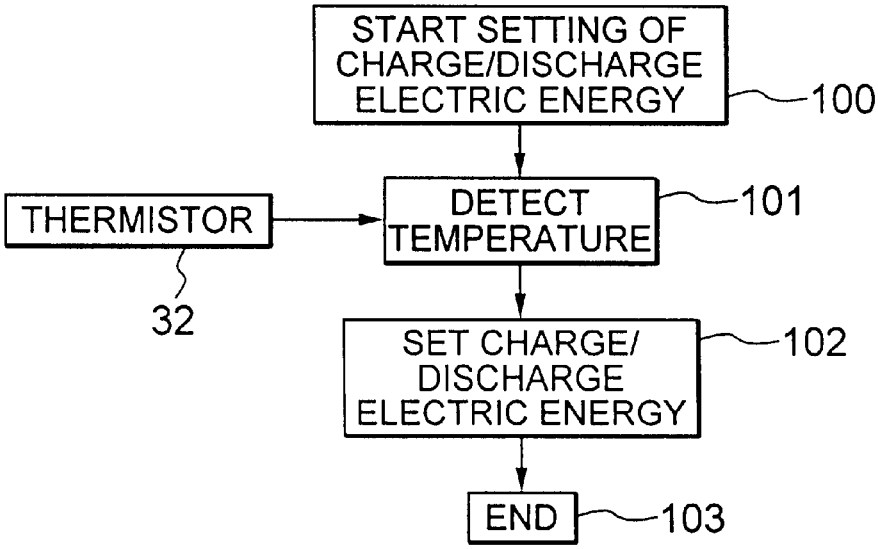
FIG. 3 is a flowchart showing an operation for setting charge/discharge electric energy of the elevator control apparatus according to the first embodiment of the present invention.

The operation of the elevator control apparatus, according to the first embodiment will now be described with reference to the accompanying drawings. FIG. 3 is a flowchart illustrating an operation for setting charge/discharge electric energy of the elevator control apparatus according to the first embodiment of the present invention.

Referring to FIG. 3, the charge/discharge control circuit 12 detects the temperature of the power storage unit 10 by the thermistor 32, and sets the charge/discharge electric energy of the power storage unit 10 based on the detected temperature (steps 100 through 103).

More specifically, the charge/discharge control circuit 12 changes the charge electric energy and the discharge electric energy according to a rise or a drop in the temperature of the power storage unit 10. For instance, if the detected temperature is low, e.g. a below-freezing temperature, then the charge or discharge electric energy is set to a value smaller than a catalog value at a temperature of 25 degrees Celsius. Similarly, if the detected temperature is high, then the charge or discharge electric energy is set to a value smaller than a catalog value at a temperature of 25 degrees Celsius. The charge electric energy and the discharge electric energy indicate maximum values for charging and discharging.

In the elevator control apparatus constructed and operated as described above, based on the charge and discharge characteristics of the power storage unit 10 that change according to temperature, the charge and discharge capacities of the power storage unit 10 at a measured temperature can be inferred. Carrying out charge and discharge control based on the charge and discharge capacities protects the power storage unit 10 from sudden deterioration.

Second Embodiment

Figure 4:
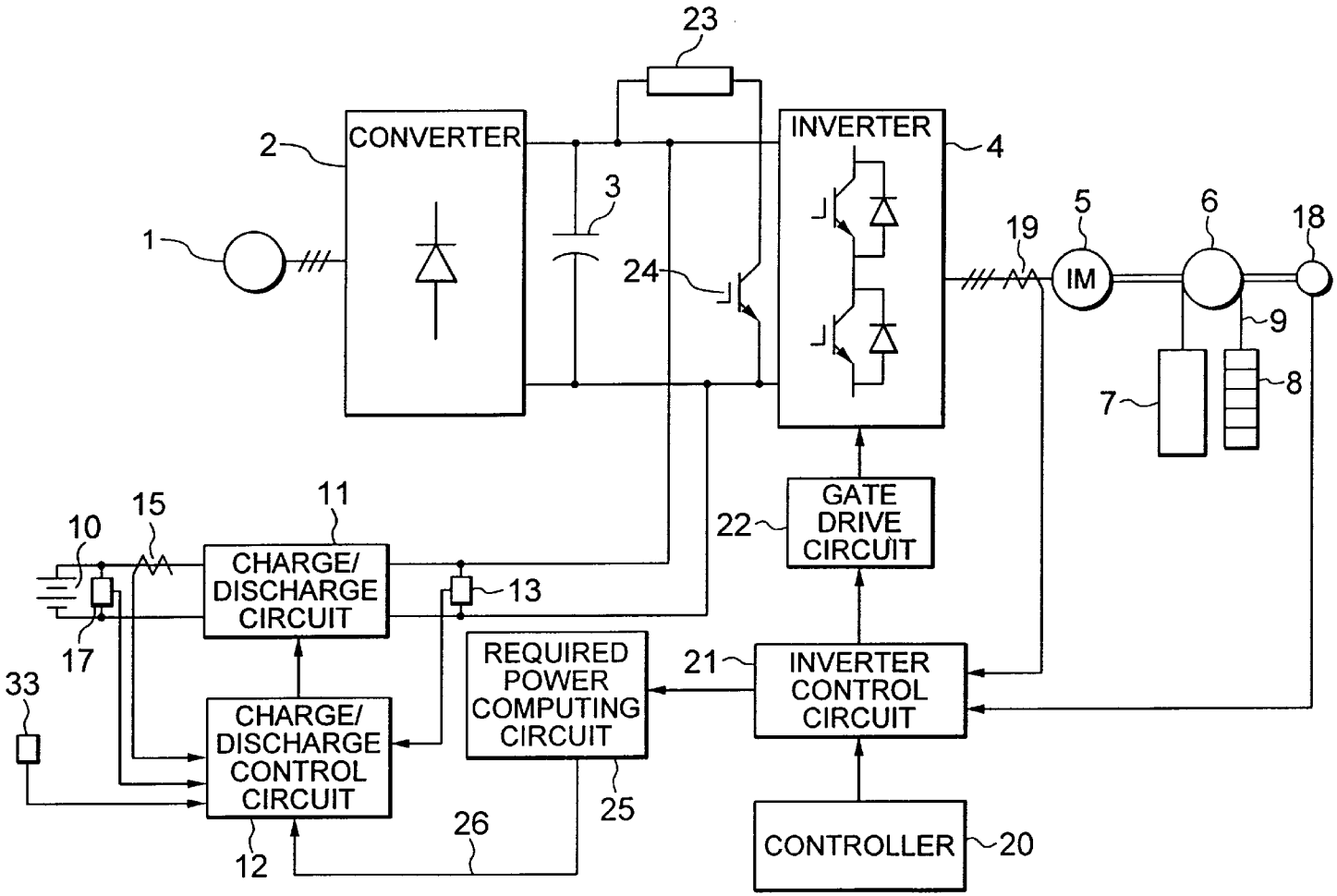
FIG. 4 is a diagram showing a construction of an elevator control apparatus according to a second embodiment of the present invention.

An elevator control apparatus according to a second embodiment of the present invention will now be described with-reference to an accompanying drawing. FIG. 4 shows a construction of the elevator control apparatus according to the second embodiment of the present invention.

In FIG. 4, like reference numerals denote like components in FIG. 1. Reference numeral 33 denotes a thermistor for measuring an atmospheric temperature or an ambient temperature. The data regarding the measured temperature is supplied to the charge/discharge control circuit 12.

Figure 5:
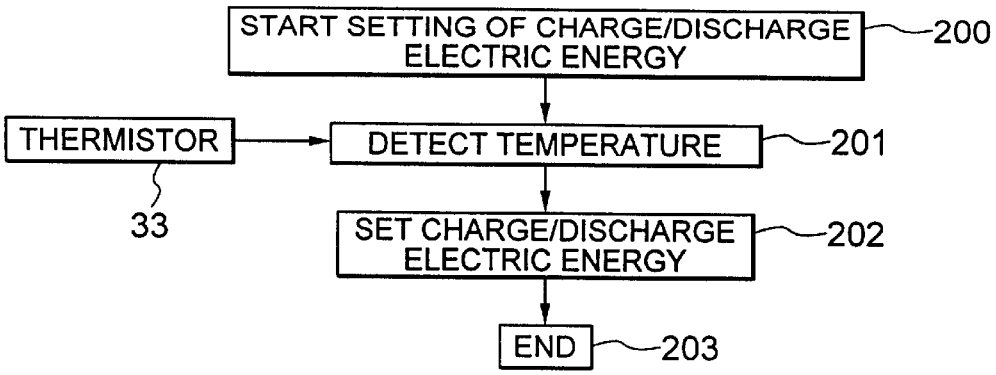
FIG. 5 is a flowchart illustrating an operation for setting a charge/discharge electric energy of the elevator control apparatus according to the second embodiment of the present invention.

An operation of the elevator control apparatus according to the second embodiment will be described with reference to an accompanying drawing. FIG. 5 is a flowchart illustrating an operation for setting charge electric energy of the elevator control apparatus according to the second embodiment.

Referring to FIG. 5, the charge/discharge control circuit 12 detects an atmospheric temperature or an environmental temperature, such as an ambient temperature, by the thermistor 33, and sets the charge/discharge electric energy of the power storage unit 10 based on the detected temperature (steps 200 through 203).

In the elevator control apparatus constructed and operated as described above, based on the charge and discharge characteristics of the power storage unit 10 that change according to temperature, the charge and discharge capacities at a measured temperature can be inferred. Carrying out charge and discharge control based on the charge and discharge capacities protects the power storage unit 10 from sudden deterioration.

Third Embodiment

An elevator control apparatus according to a third embodiment of the present invention will be described with reference to an accompanying drawing. The construction of the elevator control apparatus according to the third embodiment of the present invention is the same as that of the first embodiment.

Figure 6:
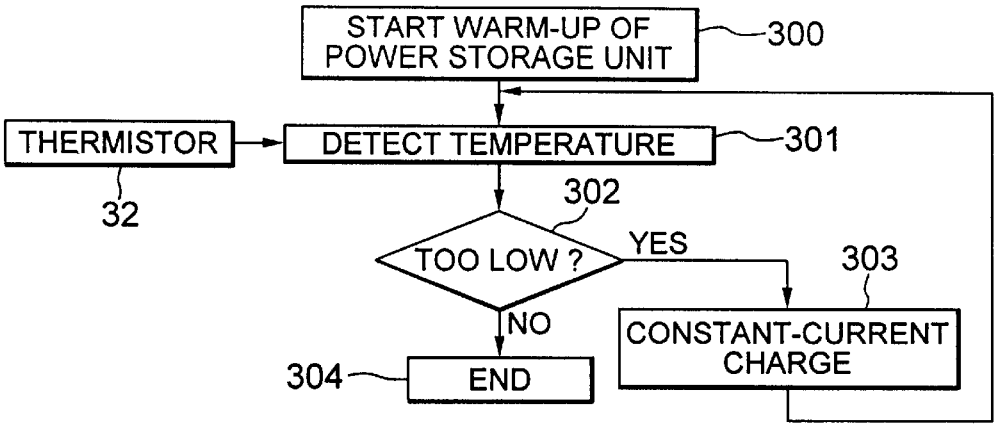
FIG. 6 is a flowchart illustrating a warm-up operation of a power storage unit of an elevator control apparatus according to a third embodiment of the present invention.

An operation of the elevator control apparatus according to the third embodiment will now be described with reference to an accompanying drawing. FIG. 6 is a flowchart illustrating a warm-up operation of a power storage unit of the elevator control apparatus according to the third embodiment of the present invention.

Referring to FIG. 6, a charge/discharge control circuit 12 detects the temperature of a power storage unit 10, and performs constant current charging within a permissible range of a charge state of the power storage unit 10 if the detected temperature is lower than a preset temperature. The constant current charging is terminated when the temperature rises (steps 300 through 304).

More specifically, the charge/discharge control circuit 12 drives the charge/discharge circuit 11 to carry out the constant current charging to warm up the power storage unit 10 if the detected temperature is so low as a below-freezing temperature or the like that leads to deterioration in the performance of the power storage unit 10.

In the elevator control apparatus constructed and operated as described above, if regenerative electric power cannot be charged due to deterioration in a charging characteristic of the power storage unit 10 at a low temperature, the constant current charging at a chargeable current value is performed to allow the temperature of the power storage unit 10 to be increased by the heat generated during the charging and also allow charge power to be stored without waste at the same time.

Fourth Embodiment

An elevator control apparatus according to a fourth embodiment of the present invention will be described with reference to an accompanying drawing. The construction of the elevator control apparatus according to the fourth embodiment of the present invention is the same as that of the first or second embodiment.

Figure 7:
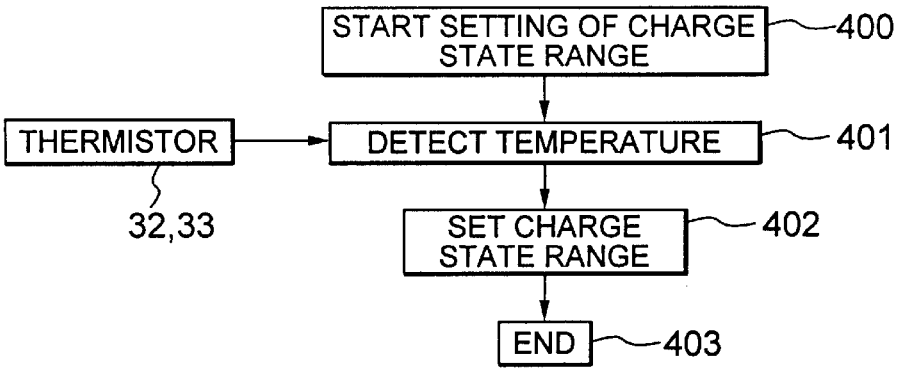
FIG. 7 is a flowchart illustrating an operation for setting a range of a charge state of an elevator control apparatus according to a fourth embodiment of the present invention.

An operation of the elevator control apparatus according to the fourth embodiment will now be described with reference to an accompanying drawing. FIG. 7 is a flowchart illustrating an operation for setting a charge state range of a power storage unit of the elevator control apparatus according to the fourth embodiment of the present invention.

Referring to FIG. 7, a temperature of a power storage unit 10, an atmospheric temperature, or an ambient temperature is detected through a thermistor 32 or 33 in order to set a charge state range of the power storage unit 10 performing charging and discharging (steps 400 through 403).

More specifically, a charge/discharge control circuit 12 changes the charge state range based on changes in the temperature of the power storage unit 10 or the atmospheric temperature. For instance, if the detected temperature is low, e.g. a below-freezing temperature, then the charge state range is set to 40 to 70%, which is smaller than a normal charge state range, e.g. 50 to 80%. Similarly, if the detected temperature is high, then the charge state range is set to values smaller than the normal charge state range, e.g. 50 to 80%.

In the elevator control apparatus constructed and operated as described above, discharge capacities or charging and discharging characteristics change with temperatures. Hence, setting the charge state range based on temperature permits efficient charging and discharging and a longer service life to be achieved.

Fifth Embodiment

An elevator control apparatus according to a fifth embodiment of the present invention will be described with reference to an accompanying drawing. The construction of the elevator control apparatus according to the fifth embodiment of the present invention is the same as that of the first or second embodiment.

Figure 8:
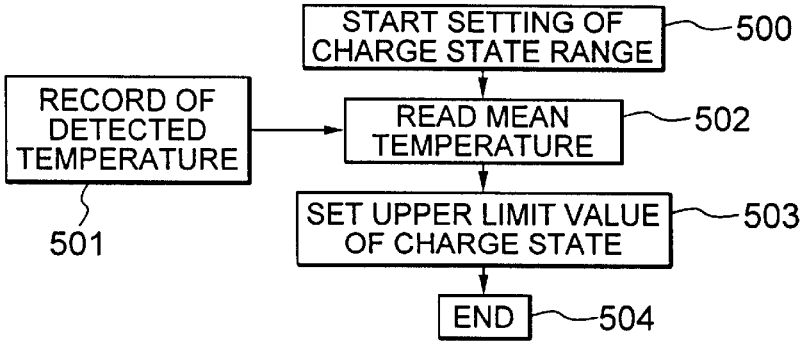
FIG. 8 is a flowchart illustrating an operation for setting a range of a charge state of an elevator control apparatus according to a fifth embodiment of the present invention.

An operation of the elevator control apparatus according to the fifth embodiment will now be described with reference to an accompanying drawing. FIG. 8 is a flowchart illustrating an operation for setting a charge state range of a power storage unit of the elevator control apparatus according to the fifth embodiment of the present invention.

Referring to FIG. 8, a charge/discharge control circuit 12 reads in a mean temperature from detection records of the temperatures of the power storage unit, atmospheric temperatures, or ambient temperatures during a predetermined period of time, and sets an upper limit value of the charge state of a power storage unit 10 that performs charging and discharging (steps 500 through 504).

More specifically, the charge/discharge control circuit 12 first calculates a mean temperature from the temperatures that have been detected mainly for setting charge state ranges and the temperatures that have already been recorded, and records the obtained mean temperature in a memory or the like. The mean temperature may be calculated after reading out temperatures during a predetermined period of time.

The charge/discharge control circuit 12 then changes an upper limit value of the charge state range based on the read mean temperature. For example, if the mean temperature is low, e.g. a below-freezing temperature, then the upper limit value of the charge state range is set to 70%, which is smaller than an upper limit value, 80%, of a normal charge state range similarly, if the mean temperature is high, then the upper limit value of the charge state range is set to a value smaller than the upper limit value, 80%, of the normal charge state range.

In the elevator control apparatus constructed and operated as described above, charging and discharging are normally performed so that the charge state stays at the upper limit value or less. With this arrangement, deterioration in charging characteristics attributable to a temperature will not cause a sudden rise in voltage or generation of an internal gas caused by regenerative electric power charging, thus making it possible to restrain degradation of the power storage unit 10. At the same time, a majority of the regenerative electric power can be charged, so that wasteful heat consumption by a resistor can be restrained, contributing to energy saving.

Sixth Embodiment

An elevator control apparatus according to a sixth embodiment of the present invention will be described with reference to an accompanying drawing. The construction of the elevator control apparatus according to the sixth embodiment of the present invention is the same as that of the first or second embodiment.

Figure 9:
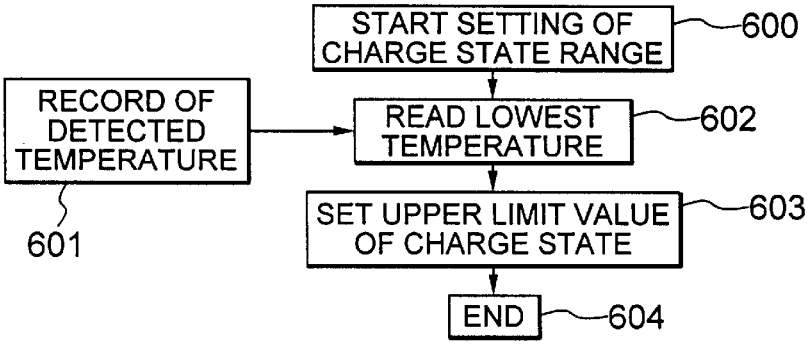
FIG. 9 is a flowchart illustrating an operation for setting a range of a charge state of an elevator control apparatus according to a sixth embodiment of the present invention.

An operation of the elevator control apparatus according to the sixth embodiment will now be described with reference to an accompanying drawing. FIG. 9 is a flowchart illustrating an operation for setting a charge state range of a power storage unit of the elevator control apparatus according to the sixth embodiment of the present invention.

Referring to FIG. 9, a charge/discharge control circuit 12 reads in a lowest temperature from detection records of the temperatures of the power storage unit 10, atmospheric temperatures, or ambient temperatures during a predetermined period of time, and sets an upper limit value of the charge state of the power storage unit 10 that performs charging and discharging (steps 600 through 604).

More specifically, the charge/discharge control circuit 12 first records the temperatures, which have been detected mainly for setting charge state ranges, in a memory or the like. The charge/discharge control circuit 12 then changes an upper limit value of the charge state range based on the read lowest temperature. For example, if the lowest temperature is low, e.g. a below-freezing temperature, then the upper limit value of the charge state range is set to 70%, which is smaller than an upper limit value, 80%, of a normal charge state range. Similarly, if the lowest temperature is high, then the upper limit value of the charge state range is set to a value smaller than the upper limit value, 80%, of the normal charge state range.

In the elevator control apparatus constructed and operated as described above, charging and discharging are normally performed so that the charge state stays at the upper limit value or less. With this arrangement, a lowest temperature at which charging characteristics deteriorate will not cause a sudden rise in voltage or generation of an internal gas caused by regenerative electric power charging, thus making it possible to restrain degradation of the power storage unit 10. At the same time, a majority of the regenerative electric power can be charged, so that wasteful heat consumption by a resistor can be restrained, contributing to energy saving.

Seventh Embodiment

An elevator control apparatus according to a seventh embodiment of the present invention will be described with reference to an accompanying drawing. The construction of the elevator control apparatus according to the seventh embodiment of the present invention is the same as that of the first or second embodiment.

Figure 10:
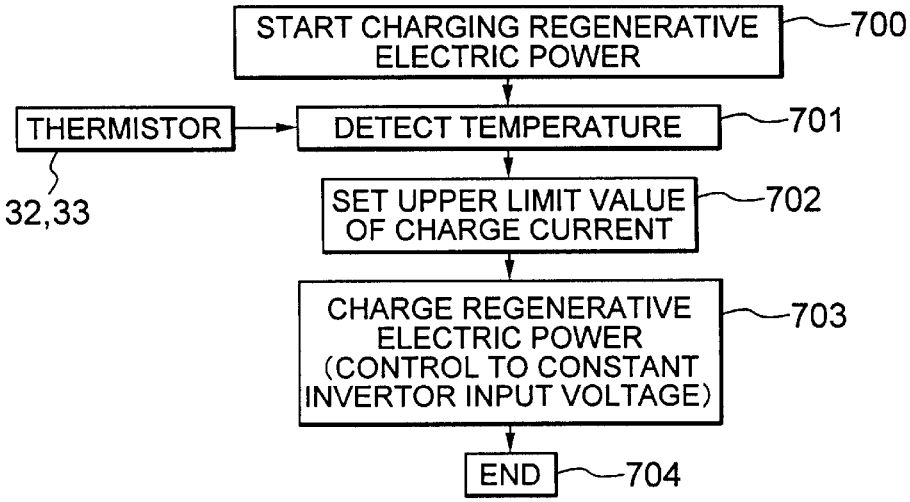
FIG. 10 is a flowchart illustrating a regenerative electric power charging operation of an elevator control apparatus according to a seventh embodiment of the present invention.

An operation of the elevator control apparatus according to the seventh embodiment will now be described with reference to an accompanying drawing. FIG. 10 is a flowchart illustrating a regenerative electric power charging operation of the elevator control apparatus according to the seventh embodiment of the present invention.

Referring to FIG. 10, a charge/discharge control circuit 12 detects a temperature of a power storage unit 10, an atmospheric temperature, or an ambient temperature through a thermistor 32 or 33 to set an upper limit value of charge current, and carries out regenerative electric power charging by controlling an inverter input voltage to a constant level (steps 700 through 704).

More specifically, the charge/discharge control circuit 12 changes the upper limit of the charge current based on a detected temperature. For instance, if the detected temperature is low, e.g. a below-freezing temperature, then the upper limit value of the charge current is set to a value that is smaller than an upper limit value of normal charge current. Similarly, if the detected temperature is high, then the upper limit value of the charge current is set to a value that is smaller than the upper limit value of the normal charge current.

Furthermore, the charge/discharge control circuit 12 drives a charge/discharge circuit 11 to perform the regenerative electric power charging such that the inverter input voltage stays constant based on voltages detected by a voltage detector 13, and that current detected by a current detector 15 does not exceed the set upper limit value of the charge current.

In the elevator control apparatus constructed and operated as described above, by providing an upper limit value based on temperature with respect to charge current that changes according to variable regenerative electric power, a sudden voltage increase or generation of an internal gas of the power storage unit 10 can be restrained. As a result, deterioration of a power storage unit 10 can be restrained, and regenerative electric power can be efficiently charged within a charging feature of the power storage unit 10.

Eighth Embodiment

An elevator control apparatus according to an eighth embodiment of the present invention will be described with reference to an accompanying drawing. The construction of the elevator control apparatus according to the eighth embodiment of the present invention is the same as that of the first or second embodiment.

Figure 11:
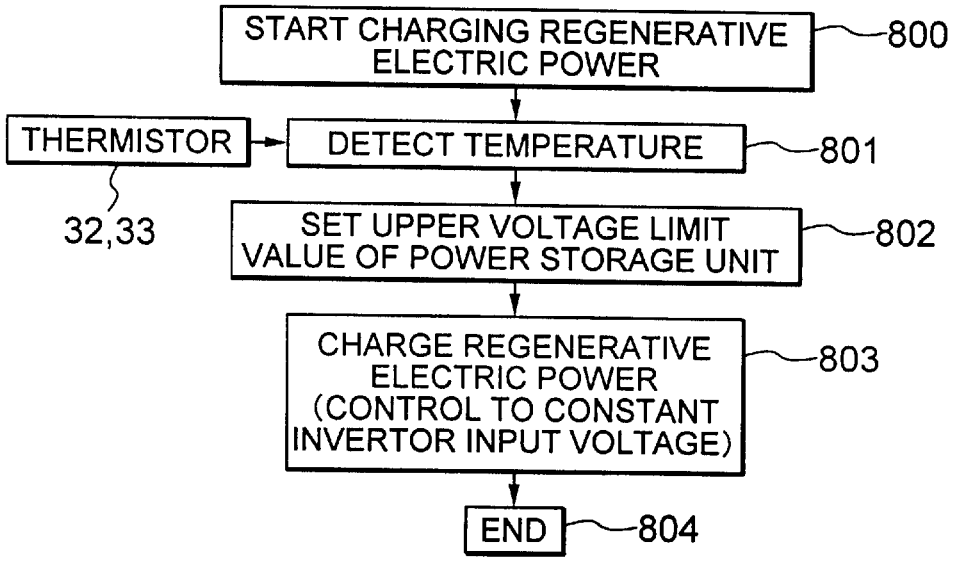
FIG. 11 is a flowchart illustrating a regenerative electric power charging operation of an elevator control apparatus according to an eighth embodiment of the present invention.
Figure 12:
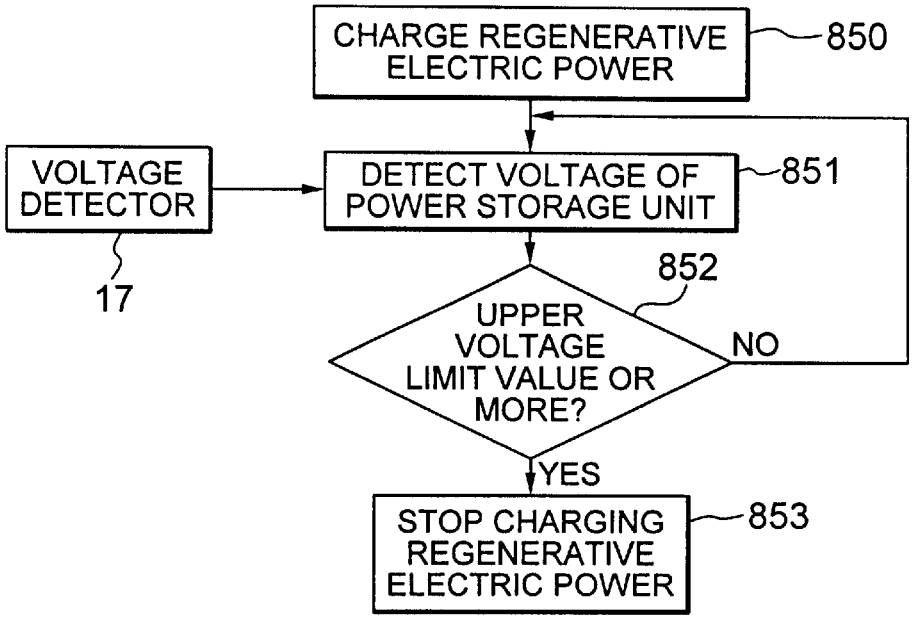
FIG. 12 is another flowchart illustrating a regenerative electric power charging operation of the elevator control apparatus according to the eighth embodiment of the present invention.

An operation of the elevator control apparatus according to the eighth embodiment will now be described with reference to accompanying drawings. FIG. 11 and FIG. 12 are flowcharts illustrating a regenerative electric power charging operation of the elevator control apparatus according to the eighth embodiment of the present invention.

Referring to FIG. 11, a charge/discharge control circuit 12 detects a temperature of a power storage unit 10, an atmospheric temperature, or an ambient temperature through a thermistor 32 or 33 to set an upper voltage limit value of the power storage unit 10, and carries out regenerative electric power charging by controlling an inverter input voltage to a constant level (steps 800 through 804).

More specifically, the charge/discharge control circuit 12 changes the upper voltage limit value based on a detected temperature. For instance, if the detected temperature is high, then the upper voltage limit value of the power storage unit 10 is set to a value that is larger than a normal upper voltage limit value of the power storage unit 10.

As shown in FIG. 12, during regenerative electric power charging, the voltage of the power storage unit 10 is detected by a voltage detector 17, and if the detected voltage value exceeds an upper voltage limit value, then the regenerative electric power charging is stopped (steps 850 through 853). Normally, the regenerative electric power charging is stopped when the regenerative electric power reaches zero.

In the elevator control apparatus constructed and operated as described above, by setting a voltage at which charging of the power storage unit 10 is terminated based on temperature, regenerative electric power can be charged within a chargeable range of the power storage unit 10, and generation of an internal gas caused by overcharging can be restrained. As a result, degradation of the power storage unit 10 can be restrained.

Ninth Embodiment

An elevator control apparatus according to a ninth embodiment of the present invention will be described with reference to an accompanying drawing. The construction of the elevator control apparatus according to the ninth embodiment of the present invention is the same as that of the first or second embodiment.

Figure 13:
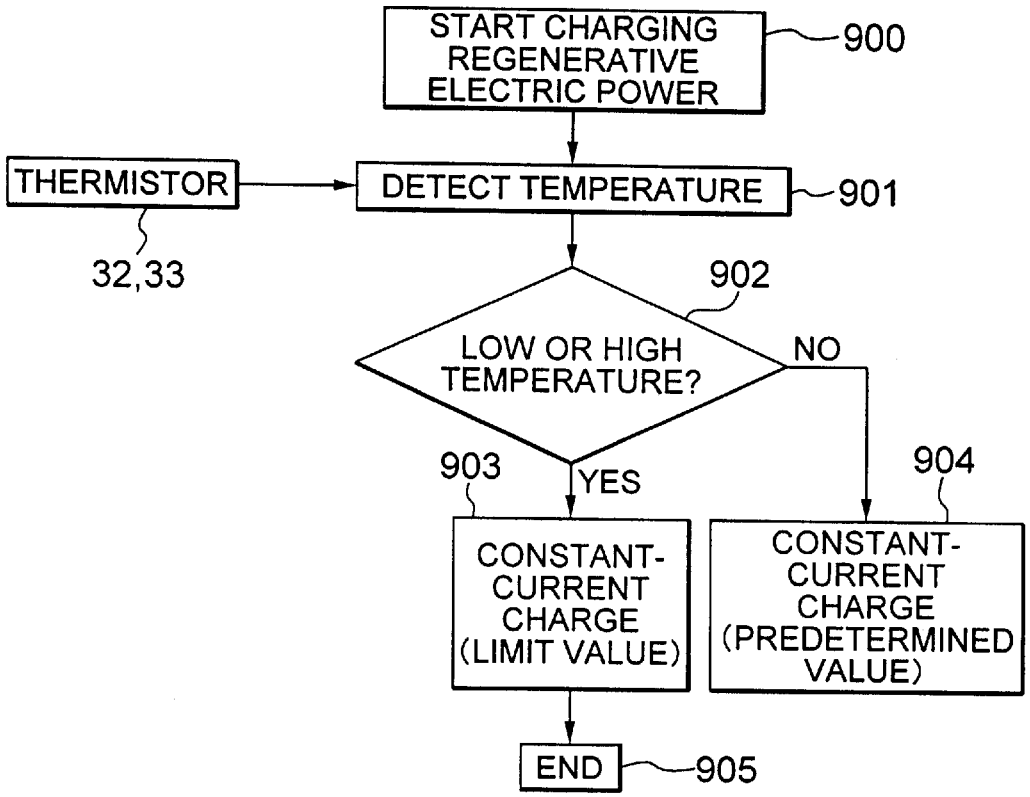
FIG. 13 is a flowchart illustrating a regenerative electric power charging operation of an elevator control apparatus according to a ninth embodiment of the present invention.

An operation of the elevator control apparatus according to the ninth embodiment will now be described with reference to an accompanying drawing. FIG. 13 is a flowchart illustrating a regenerative electric power charging operation of the elevator control apparatus according to the ninth embodiment of the present invention.

Referring to FIG. 13, a charge/discharge control circuit 12 detects a temperature of a power storage unit, an atmospheric temperature, or an ambient temperature through a thermistor 32 or 33. If the detected temperature is a preset temperature or less (a low temperature) or a preset temperature or more (a high temperature), then constant current charging, in which a current value at which a power storage unit 10 is filled with regenerative electric power produced at an elevator is limited, is performed; otherwise, constant current charging at a preset predetermined current value is performed (steps 900 through 905).

More specifically, the charge/discharge control circuit 12 carries out the constant current charging at a small current if the detected temperature is other than a normal temperature, and carries out the constant current charging at a predetermined current value at a normal temperature.

If the constant current charging is performed with a limited current value when the detected temperature is low or high, there are cases where all regenerative electric power cannot be supplied to the power storage unit 10. Regenerative power that causes an input voltage of an inverter 4 to increase and exceed a permissible voltage is thermally consumed by a resistor 23. More specifically, the charge/discharge control circuit 12 sends a signal to that effect to a controller 20 via a communication cable (not shown), and the controller 20 turns on a switching means 24 to thermally consume the regenerative electric power by the resistor 23. Alternatively, the charge/discharge control circuit 12 may directly turn on the switching means 24.

The elevator control apparatus constructed and operated as described above is capable of performing constant current charging at a current value ensuring most efficient charging at a normal temperature, while performing the constant current charging at a current limited to a chargeable current value at a low or high temperature at which the charging capability of the power storage unit 10 is deteriorated. This arrangement makes it possible to restrain a sudden voltage increase or generation of an internal gas of the power storage unit 10. As a result, deterioration of the power storage unit 10 can be controlled.

Tenth Embodiment

Figure 14:
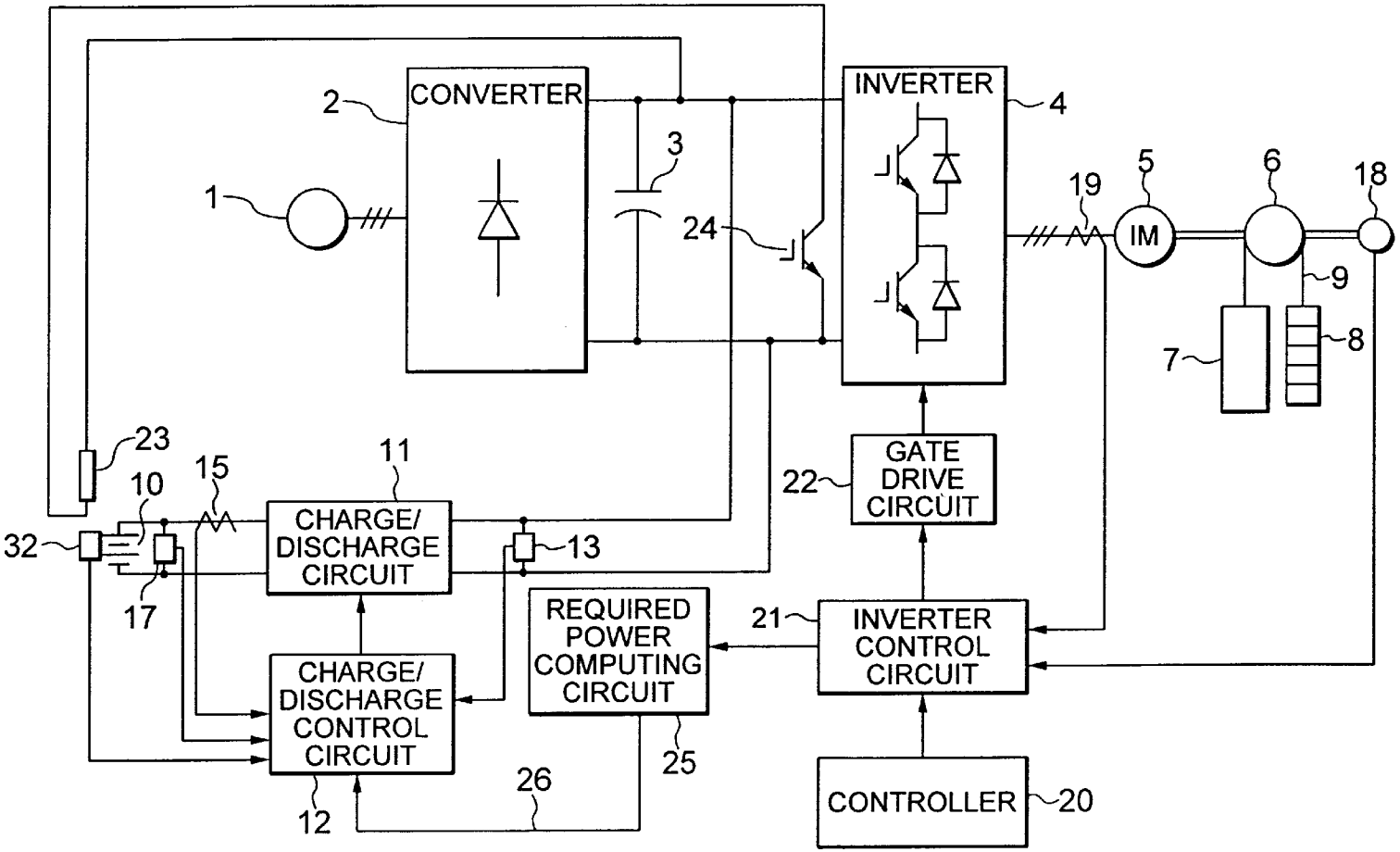
FIG. 14 is a diagram showing a construction of an elevator control apparatus according to a tenth embodiment of the present invention.

An elevator control apparatus according to a tenth embodiment of the present invention will be described with reference to the accompanying drawings. FIG. 14 shows a construction of the elevator control apparatus according to the tenth embodiment of the invention.

In FIG. 14, the same reference numerals as those in FIG. 1 denote the same components. A resistor 23 is disposed in the vicinity of a power storage unit 10. Heat generated at the resistor 23 is transmitted to the power storage unit 10.

Figure 15:
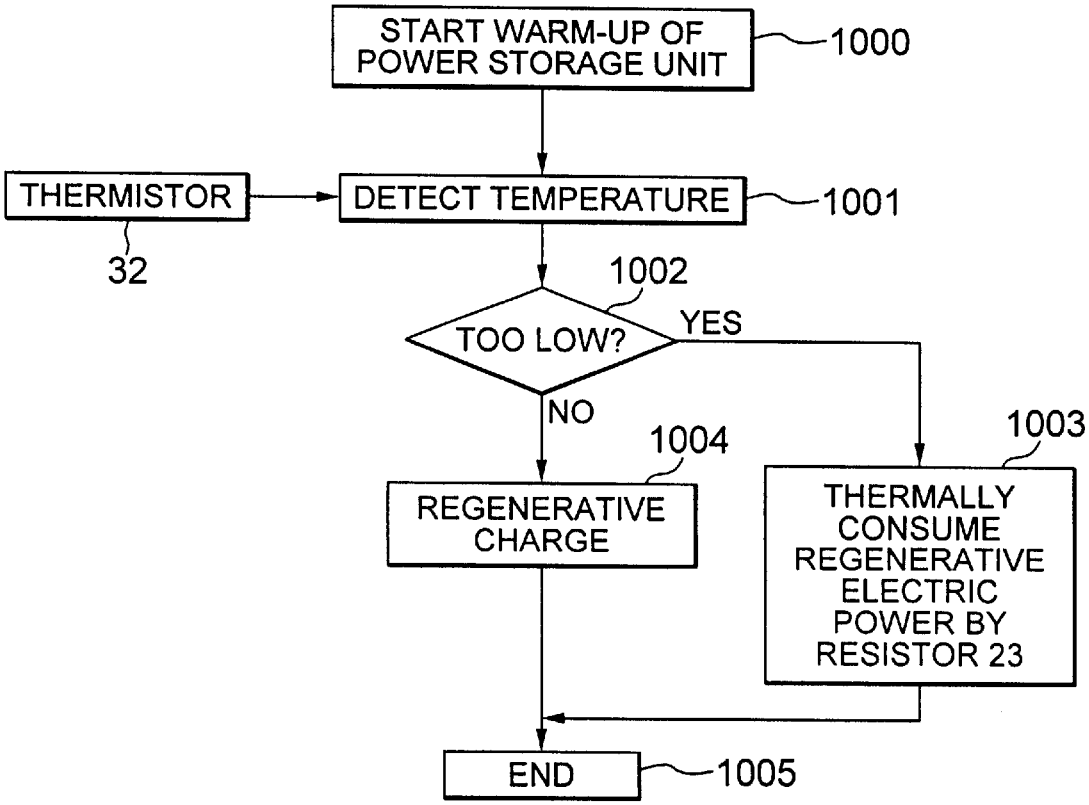
FIG. 15 is a flowchart illustrating a warm-up operation of a power storage unit of the elevator control apparatus according to the tenth embodiment of the present invention.

An operation of the elevator control apparatus in accordance with,the tenth embodiment will now be described with reference to the accompanying drawings. FIG. 15 shows a flowchart illustrating a warm-up operation of a power storage unit of the elevator control apparatus according to the tenth embodiment of the present invention.

Referring to FIG. 15, the charge/discharge control circuit 12 detects a temperature of the power storage unit 10 through a thermistor 32. If the detected temperature is low, then the charge/discharge control circuit 12 consumes regenerative electric power by the resistor 23 to warm up the power storage unit 10 by the generated heat; otherwise, the charge/discharge control circuit 12 performs regular regenerative charging (steps 1000 through 1005).

More specifically, if the detected temperature is a low temperature, e.g. a below-freezing temperature, which prevents the power storage unit 10 from being charged with regenerative electric power, causing in turn the input voltage of the inverter 4 to increase and exceed a permissible voltage level, then the charge/discharge control circuit 12 turns on a switching means 24 via the controller 20 thereby to consume the regenerative electric power by the resistor 23 and to warm up the power storage unit 10 by the heat generated at the resistor 23. Alternatively, the charge/discharge control circuit 12 may directly turn on the switching means 24.

The elevator-control apparatus constructed and operated as described above is adapted to warm up the power storage unit 10 by utilizing the heat generated by the resistor, which consumes regenerative electric power, if the regenerative electric power cannot be sufficiently charged due to deteriorated charging characteristics of the power storage unit 10 at a low temperature. This arrangement obviates the need for consuming electric power supplied from a commercial power source 1 for heating, permitting an increase in electricity rate to be restrained.

Eleventh Embodiment

Figure 16:
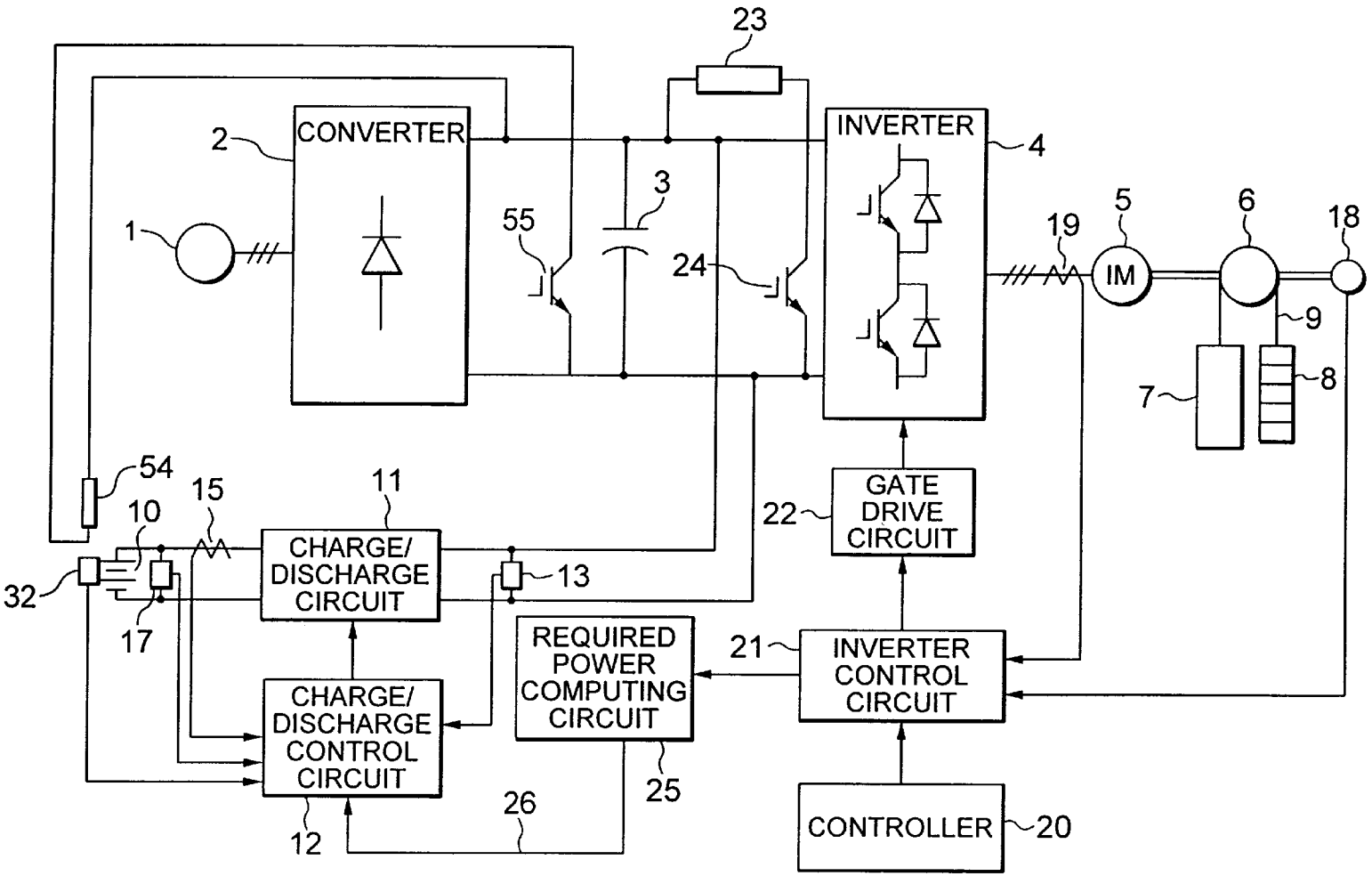
FIG. 16 is a diagram showing a construction of an elevator control apparatus according to an eleventh embodiment of the present invention.

An elevator control apparatus according to an eleventh embodiment of the present invention will be described with reference to the accompanying drawings. FIG. 16 shows a construction of the elevator control apparatus according to the eleventh embodiment of the invention.

In FIG. 16, the same reference numerals as those in FIG. 1 denote the same components. A resistor 23 for protecting a capacitor 3 is installed separately from a power storage unit 10, and a resistor 54 is disposed in the vicinity of the power storage unit 10. By connecting the resistors to the capacitor 3 via a switching means 55, the heat generated at a resistor 54 is transmitted to the power storage unit 10.

Figure 17:
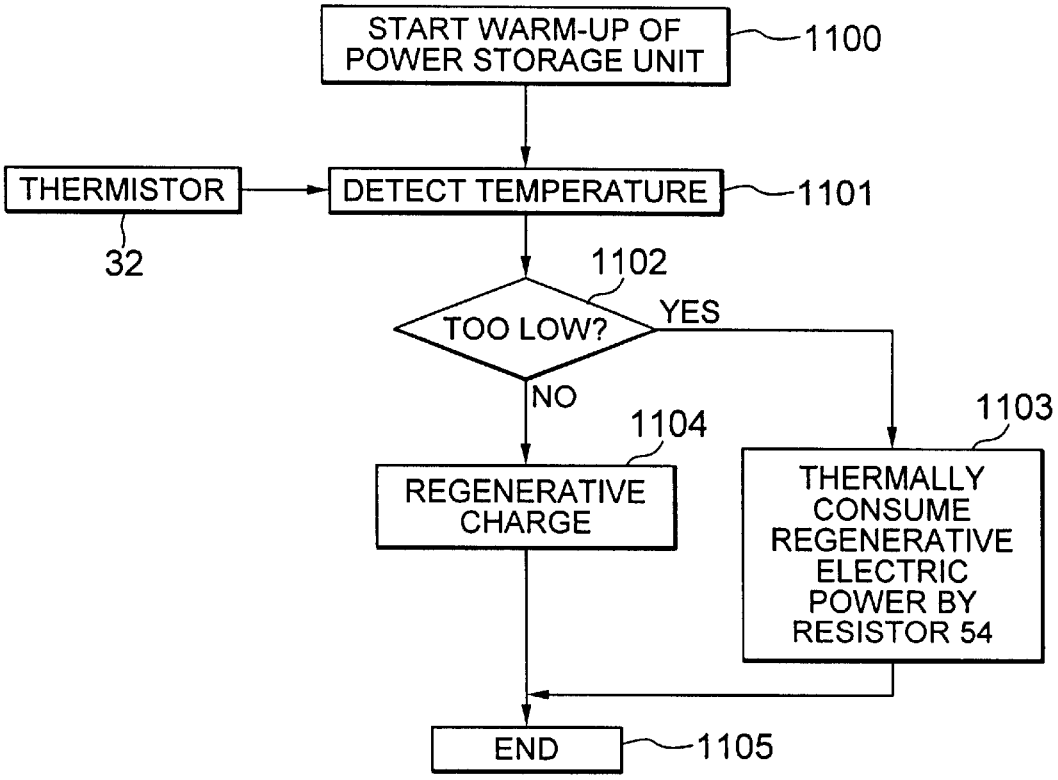
FIG. 17 is a flowchart illustrating a warm-up operation of a power storage unit of the elevator control apparatus according to the eleventh embodiment of the present invention.

An operation of the elevator control apparatus in accordance with the eleventh embodiment will now be described with reference to the accompanying drawings. FIG. 17 shows a flowchart illustrating a warm-up operation of a power storage unit of the elevator control apparatus according to the eleventh embodiment of the present invention.

Referring to FIG. 17, a charge/discharge control circuit 12 detects a temperature of the power storage unit 10 through a thermistor 32. If the detected temperature is low, then regenerative electric power is consumed by the resistor 54 to warm up the power storage unit 10 by the generated heat; otherwise, the charge/discharge control circuit performs regular regenerative charging, and employs the resistor 23 if the regenerative electric power need to be thermally consumed.

More specifically, if the detected temperature is a low temperature, e.g. a below-freezing temperature, that prevents the power storage unit 10 from being charged with regenerative electric power, causing in turn the input voltage of the inverter 4 to increase and exceed a permissible voltage level, then the charge/discharge control circuit 12 turns on the switching means 55 via a controller 20 thereby to warm up the power storage unit 10 by the heat generated at the resistor 54. Alternatively, the charge/discharge control circuit 12 may directly turn on the switching means 55.

The elevator control apparatus constructed and operated as described above provides the same advantages as those of the foregoing tenth embodiment. Moreover, heat consumption of regenerative electric power by the resistor 54 disposed in the vicinity of the power storage unit 10 is not performed unless the power storage unit 10 is cold. With this arrangement, the temperature of the power storage unit 10 is not raised unless it is necessary, thus allowing the deterioration of the power storage unit 10 to be controlled.

Twelfth Embodiment

Figure 18:
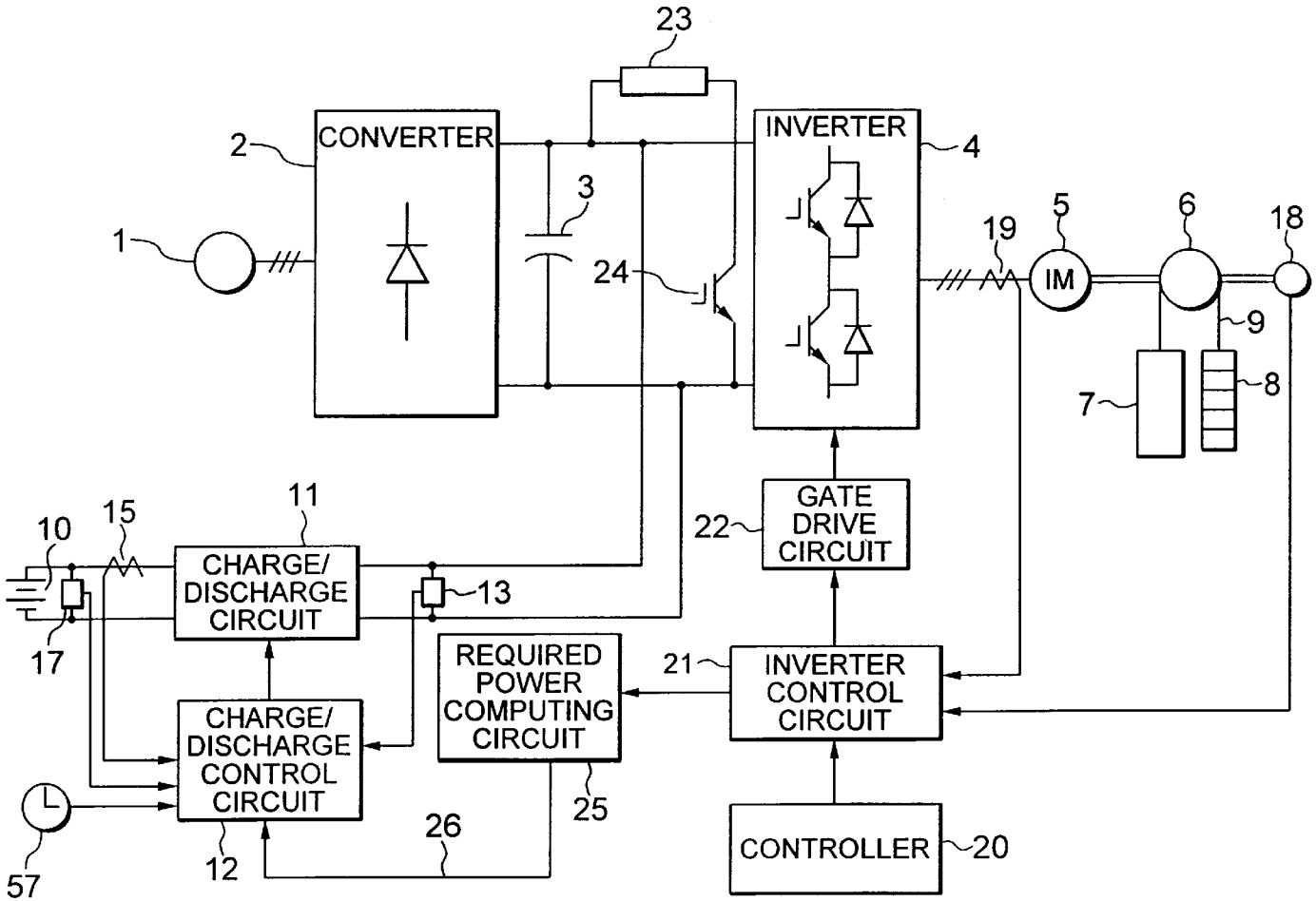
FIG. 18 is a diagram showing a construction of an elevator control apparatus according to a twelfth embodiment of the present invention.

An elevator control apparatus according to a twelfth embodiment of the present invention will be described with reference to the accompanying drawings. FIG. 18 shows a construction of the elevator control apparatus according to the twelfth embodiment of the invention.

In FIG. 18, the same reference numerals as those in FIG. 1 denote the same components. A charge/discharge control circuit 12 has a built-in or externally installed clock function 57 to acquire time of day.

Figure 19:
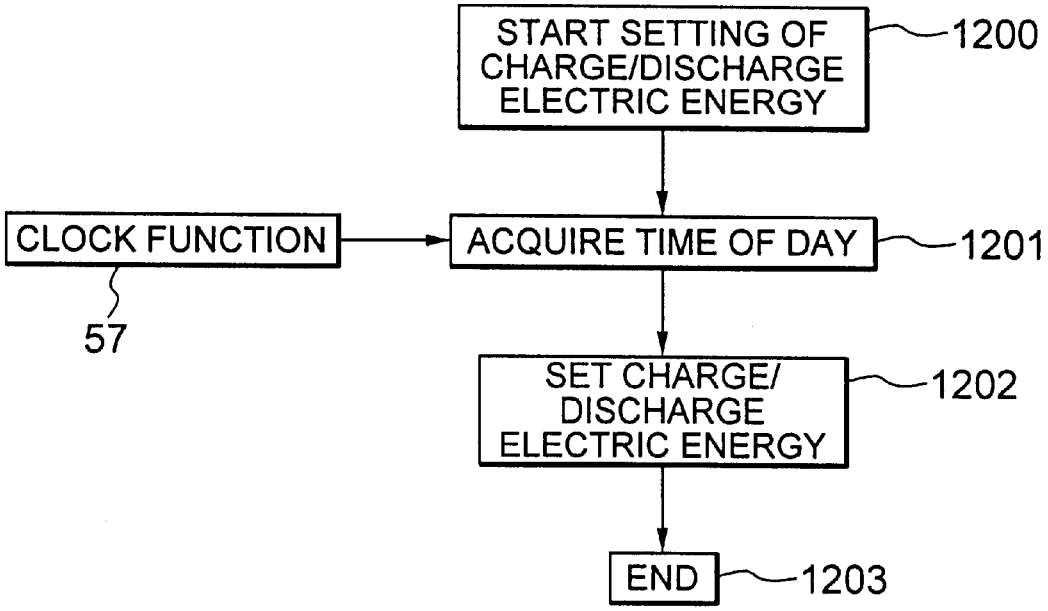
FIG. 19 is a flowchart showing an operation for setting charge/discharge electric energy of the elevator control apparatus according to the twelfth embodiment of the present invention.
Figure 20:
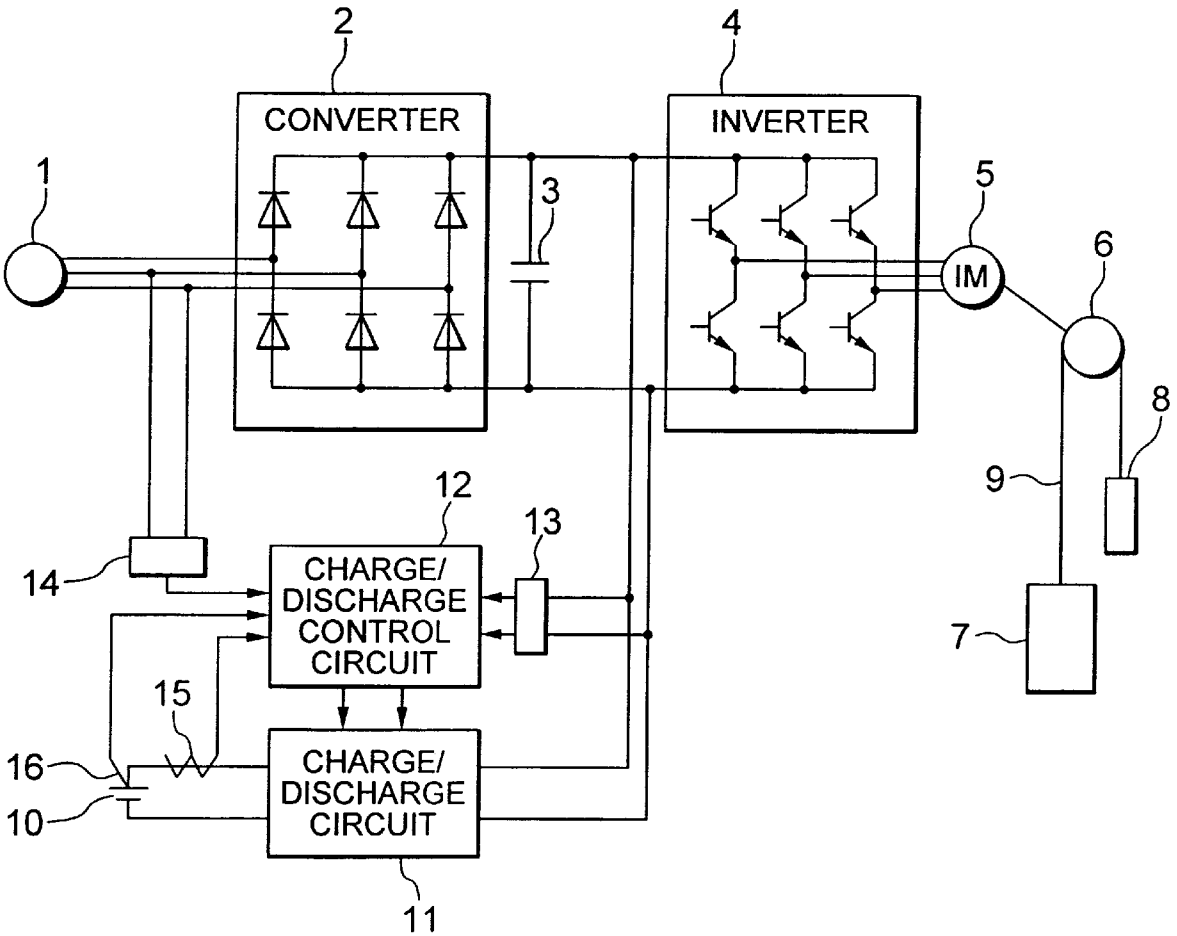
FIG. 20 PRIOR ART
FIG. 20 is a diagram showing a construction of a conventional elevator control apparatus.

An operation of the elevator control apparatus in accordance with the twelfth embodiment will now be described with reference to the accompanying drawings. FIG. 19 shows a flowchart illustrating an operation for setting a charge/discharge electric energy of the elevator control apparatus according to the twelfth embodiment of the present invention.

Referring to FIG. 19, a charge/discharge control circuit 12 acquires time of day from a clock function 57. Based on the acquired time of day, the charge/discharge control circuit 12 sets a charge/discharge electric energy of a power storage unit 10 suited to a particular time of day, date, month, or season (steps 1200 through 1203).

More specifically, the charge/discharge control circuit 12 estimates a temperature or atmospheric temperature based on the acquired time, and sets the charge/discharge electric energy of the power storage unit 10 based the temperature as discussed in, for example, the foregoing first embodiment. For instance, the charge/discharge control circuit 12 predicts that temperatures are lower in the morning and higher during the daytime. The prediction may be performed using a table showing times and temperatures at these times based on data regarding past weather. The same applies to months and seasons.

The elevator control apparatus constructed and operated as described above is able to find a temperature suited to a particular time of day, date, month, or season based on data regarding the time of day acquired by the clock function 57, estimate a charging and discharging capability of the power storage unit 10 from the charging and discharging characteristics of the power storage unit 10 that change with temperatures, and control charging and discharging based on the estimated charging and discharging capability. This arrangement permits protection of the power storage unit 10, so that sudden deterioration of the power storage unit 10 can be restrained.

What is claimed is:

1. An elevator control apparatus comprising:

a converter for rectifying AC power to produce DC power;

an inverter for converting the DC power into AC power having a variable voltage and a variable frequency;

DC buses connecting the converter to the inverter;

a controller for controlling a motor, based on the AC power having a variable voltage and variable frequency, the motor operating an elevator;

a chargeable and dischargeable power storage unit for storing and discharging DC power;

temperature detecting means for detecting temperature of the power storage unit;

a charge/discharge control circuit, inferring charging and discharging capacities of the power storage unit with temperature and controlling charging and discharging of the power storage unit based on the inferred charging and discharging capacity for the temperature detected, and issuing, in response, a drive signal; and a charge/discharge circuit coupling the power storage unit to the DC buses and charging and discharging the power storage unit in response to the drive signal issued by the charge/discharge control circuit, with the DC power supplied from the DC buses and supplying stored DC power to the DC buses, respectively.

2. An elevator control apparatus comprising:

a converter for rectifying AC power to produce DC power;

an inverter for converting the DC power into AC power having a variable voltage and a variable frequency;

DC buses connecting the converter to the inverter;

a controller for controlling a motor, based on the AC power having a variable voltage and variable frequency, the motor operating an elevator;

a chargeable and dischargeable power storage unit for storing and discharging DC power;

temperature detecting means for detecting environmental temperature;

a charge/discharge control circuit, inferring charging and discharging capacities of the power storage unit with temperature, and controlling charging and discharging of the power storage unit based on the inferred charging and discharging capacity for the temperature detected, and issuing, in response, a drive signal; and a charge/discharge circuit coupling the power storage unit to the DC buses and charging and discharging the power storage unit in response to the drive signal issued by the charge/discharge control circuit, with the DC power supplied from the DC buses and supplying stored DC power to the DC buses, respectively.

3. The elevator control apparatus according to claim 1, wherein the charge/discharge control circuit issues a drive signal for charging within a permissible range of a charge state of the power storage unit if the temperature of the power storage unit is lower than a preset temperature.

4. The elevator control apparatus according to claim 1, wherein the charge/discharge control circuit changes a range of a charge state of the power storage unit based on the temperature detected.

5. The elevator control apparatus according to claim 1, wherein the charge/discharge control circuit changes an upper limit of a charge state of the power storage unit based on a mean of temperatures detected during a preset period of time.

6. The elevator control apparatus according to claim 1, wherein the charge/discharge control circuit changes an upper limit of a charge state of the power storage unit based on a lowest of temperatures detected during a preset period of time.

7. The elevator control apparatus according to claim 1 wherein the charge/discharge control circuit sets an input voltage of the inverter to a constant preset voltage, and issues a drive signal for charging the power storage unit with regenerative electric power so that, when a charging current supplied to the power storage unit reaches an upper limit based on the temperature detected, the charging current does not exceed the upper limit.

8. The elevator control apparatus according to claim 1, wherein the charge/discharge control circuit controls charging of the power storage unit with regenerative electric power so that an input voltage of the inverter is set at a constant preset voltage, and issues a drive signal for stopping charging of the power storage unit with regenerative electric power when a voltage of the power storage unit reaches an upper limit based on the temperature detected.

9. The elevator control apparatus according to claim 1, wherein the charge/discharge control circuit sets a charging current supplied to the power storage unit at a first constant current, and sets the charging current supplied to the power storage unit at a second constant current lower than the first constant current and issues a drive signal for charging the power storage unit with regenerative electric power if the temperature detected is not more than a first temperature or not less than a second temperature higher than the first temperature.

10. An elevator control apparatus according to claim 1, further comprising a first resistor proximate the power storage unit, wherein the charge/discharge control circuit directs regenerative electric power to the first resistor if the temperature detected does not exceed a predetermined temperature.

11. An elevator control apparatus according to claim 10, further comprising a second resistor disposed at a remote location, distant from the power storage unit, wherein the charge/discharge control circuit directs regenerative electric power to the first resistor if the temperature of the power storage unit is below a first temperature, or directs the regenerative electric power to the second resistor if the temperature of the power storage unit is at least a second temperature and the power storage unit cannot be charged with the regenerative electric power.

12. The elevator control apparatus according to claim 2, wherein the charge/discharge control circuit changes a range of a charge state of the power storage unit based on the temperature detected.

13. The elevator control apparatus according to claim 2, wherein the charge/discharge control circuit changes an upper limit of a charge state of the power storage unit based on a mean of temperatures detected during a preset period of time.

14. The elevator control apparatus according to claim 2, wherein the charge/discharge control circuit changes an upper limit of a charge state of the power storage unit based on a lowest of temperatures detected during a preset period of time.

15. The elevator control apparatus according to claim 2, wherein the charge/discharge control circuit sets an input voltage of the inverter to a constant preset voltage, an issues a drive signal for charging the power storage unit with regenerative electric power so that, when a charging current supplied to the power storage unit reaches an upper limit based on the temperature detected, the charging current does not exceed the upper limit.

16. The elevator control apparatus according to claim 2, wherein the charge/discharge control circuit controls charging of the power storage unit with regenerative electric power so that an input voltage of the inverter is set at a constant preset voltage, and issues a drive signal for stopping charging of the power storage unit with regenerative electric power when a voltage of the power storage unit reaches an upper limit based on the temperature detected.

17. The elevator control apparatus according to claim 2, wherein the charge/discharge control circuit sets a charging current supplied to the power storage unit at a first constant current, and issues a drive signal for charging the power storage unit with regenerative electric power while setting charging current supplied to the power storage unit at a second constant current lower than the first constant current if the temperature detected is not more than a first temperature or not less than a second temperature higher than the first temperature.

* * * * *